US008729440B2

(12) United States Patent
Parsche

(10) Patent No.: US 8,729,440 B2
(45) Date of Patent: May 20, 2014

(54) APPLICATOR AND METHOD FOR RF HEATING OF MATERIAL

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 1079 days.

(21) Appl. No.: 12/396,057

(22) Filed: Mar. 2, 2009

(65) Prior Publication Data

US 2010/0219184 A1 Sep. 2, 2010

(51) Int. Cl.
*H05B 6/74* (2006.01)

(52) U.S. Cl.
USPC ..... 219/747; 219/713; 219/725; 219/745; 219/748; 219/756; 219/771; 219/772; 219/761; 166/177.1; 166/177.2; 208/390; 392/301; 392/306; 343/773; 343/774; 343/899; 343/912; 343/915

(58) Field of Classification Search
CPC ..... H01Q 21/20; H01Q 9/28; H01Q 9/04; H05B 6/802; H05B 6/745; H05B 6/80; H05B 6/74; H05B 6/72
USPC ..... 166/177.1–177.2; 204/118, 204/157.15–157.99, 291, 410, 514, 669, 204/799; 208/390; 219/713, 725, 745, 219/747–748, 756, 771–772, 746, 761; 392/301, 306; 343/773, 774, 899, 912, 343/915; 315/39.3; 363/132, 17
See application file for complete search history.

(56) References Cited

U.S. PATENT DOCUMENTS

| | | | | |
|---|---|---|---|---|
| 2,036,203 A * | 4/1936 | Engel | 343/888 |
| 2,371,459 A | 3/1945 | Mitielmann | |
| 2,518,564 A * | 8/1950 | Nebel | 342/158 |
| 2,685,930 A | 8/1954 | Albaugh | |
| 2,920,322 A * | 1/1960 | Brown, Jr. | 343/776 |

(Continued)

FOREIGN PATENT DOCUMENTS

| | | |
|---|---|---|
| CA | 1199573 A1 | 1/1986 |
| CA | 2678473 | 8/2009 |

(Continued)

OTHER PUBLICATIONS

Cyclonic Separation, Wikipedia, 2007.*

(Continued)

*Primary Examiner* — Dana Ross
*Assistant Examiner* — Brett Spurlock
(74) *Attorney, Agent, or Firm* — Allen, Dyer, Doppelt, Milbrath & Gilchrist, P.A.

(57) ABSTRACT

A radio frequency heater is disclosed including a vessel for containing material to be heated and a radio frequency radiating surface. The vessel has a wall defining a reservoir. The radio frequency radiating surface at least partially surrounds the reservoir. The radiating surface includes two or more circumferentially spaced petals that are electrically isolated from other petals. The petals are positioned to irradiate at least a portion of the reservoir, and are adapted for connection to a source of radio frequency alternating current. A generally conical tank or tank segment having a conically wound radio frequency applicator is also contemplated. Also, a method of heating an oil-water process stream is disclosed. In this method a radio frequency heater and an oil-water process stream are provided. The process stream is irradiated with the heater, thus heating the water phase of the process stream.

11 Claims, 4 Drawing Sheets

(56) References Cited

U.S. PATENT DOCUMENTS 3,497,005 A 2/1970 Pelopsky
3,848,671 A 11/1974 Kern
3,954,140 A 5/1976 Hendrick
3,988,036 A 10/1976 Fisher
3,991,091 A 11/1976 Driscoll
4,035,282 A 7/1977 Stuchberry et al.
4,042,487 A 8/1977 Seguchi
4,074,268 A * 2/1978 Olson ..... 342/399
4,087,781 A 5/1978 Grossi et al.
4,136,014 A 1/1979 Vermeulen
4,140,179 A 2/1979 Kasevich et al.
4,140,180 A 2/1979 Bridges et al.
4,144,935 A 3/1979 Bridges et al.
4,146,125 A 3/1979 Sanford et al.
4,193,448 A * 3/1980 Jeambey ..... 166/60
4,196,329 A 4/1980 Rowland et al.
4,295,880 A 10/1981 Horner
4,300,219 A 11/1981 Joyal
4,301,865 A 11/1981 Kasevich et al.
4,328,324 A 5/1982 Kock
4,373,581 A 2/1983 Toellner
RE31,241 E * 5/1983 Klaila ..... 431/11
4,396,062 A 8/1983 Iskander
4,404,123 A 9/1983 Chu
4,410,216 A 10/1983 Allen
4,417,311 A * 11/1983 Ryan ..... 700/270
4,425,227 A 1/1984 Smith
4,449,585 A 5/1984 Bridges et al.
4,456,065 A 6/1984 Heim
4,457,365 A 7/1984 Kasevich et al.
4,470,459 A 9/1984 Copland
4,485,869 A 12/1984 Sresty
4,487,257 A 12/1984 Dauphine
4,508,168 A 4/1985 Heeren
4,514,305 A 4/1985 Filby
4,524,827 A 6/1985 Bridges
4,531,468 A 7/1985 Simon
4,583,586 A 4/1986 Fujimoto et al.
4,608,572 A * 8/1986 Blakney et al. ..... 343/792.5
4,620,593 A 11/1986 Haagensen
4,622,496 A 11/1986 Dattili
4,645,585 A 2/1987 White
4,678,034 A 7/1987 Eastlund
4,703,433 A 10/1987 Sharrit
4,790,375 A 12/1988 Bridges
4,817,711 A 4/1989 Jeambey
4,882,984 A 11/1989 Eves, II
4,892,782 A 1/1990 Fisher et al.
5,019,832 A * 5/1991 Ekdahl ..... 343/774
5,046,559 A 9/1991 Glandt
5,055,180 A 10/1991 Klaila
5,065,819 A 11/1991 Kasevich
5,082,054 A 1/1992 Kiamanesh
5,134,420 A * 7/1992 Rosen et al. ..... 343/756
5,136,249 A 8/1992 White
5,199,488 A 4/1993 Kasevich
5,223,148 A * 6/1993 Tipman et al. ..... 210/744
5,233,306 A 8/1993 Misra
5,236,039 A 8/1993 Edelstein
5,246,554 A * 9/1993 Cha ..... 204/157.3
5,251,700 A 10/1993 Nelson
5,293,936 A 3/1994 Bridges
5,304,767 A 4/1994 McGaffigan
5,315,561 A 5/1994 Grossi
5,321,222 A * 6/1994 Bible et al. ..... 219/745
5,370,477 A 12/1994 Bunin
5,378,879 A 1/1995 Monovoukas
5,506,592 A 4/1996 MacDonald
5,521,360 A * 5/1996 Johnson et al. ..... 219/709
5,582,854 A 12/1996 Nosaka
5,621,844 A 4/1997 Bridges
5,631,562 A 5/1997 Cram
5,723,042 A * 3/1998 Strand et al. ..... 208/391
5,746,909 A 5/1998 Calta
5,804,967 A * 9/1998 Miller et al. ..... 324/314
5,910,287 A 6/1999 Cassin
5,923,299 A 7/1999 Brown et al.
5,944,902 A * 8/1999 Redeker et al. ..... 118/723 AN
6,045,648 A 4/2000 Palmgren et al.
6,046,464 A 4/2000 Schetzina
6,055,213 A 4/2000 Rubbo
6,063,338 A 5/2000 Pham
6,077,400 A * 6/2000 Kartchner ..... 204/157.15
6,097,262 A 8/2000 Combellack
6,106,895 A 8/2000 Usuki
6,112,273 A 8/2000 Kau
6,184,427 B1 2/2001 Klepfer
6,229,603 B1 5/2001 Coassin
6,232,114 B1 5/2001 Coassin
6,301,088 B1 10/2001 Nakada
6,303,021 B2 10/2001 Winter
6,337,664 B1 * 1/2002 Mayes et al. ..... 343/749
6,348,679 B1 2/2002 Ryan et al.
6,360,819 B1 3/2002 Vinegar
6,432,365 B1 8/2002 Levin
6,530,484 B1 * 3/2003 Bosman ..... 209/732
6,603,309 B2 8/2003 Forgang
6,608,598 B2 * 8/2003 Gee et al. ..... 343/749
6,613,678 B1 9/2003 Sakaguchi
6,614,059 B1 9/2003 Tsujimura
6,649,888 B2 11/2003 Ryan et al.
6,712,136 B2 3/2004 de Rouffignac
6,726,828 B2 * 4/2004 Turner et al. ..... 205/547
6,808,935 B2 10/2004 Levin
6,923,273 B2 8/2005 Terry
6,932,155 B2 8/2005 Vinegar
6,967,589 B1 11/2005 Peters
6,992,630 B2 1/2006 Parsche
7,010,459 B2 * 3/2006 Eryurek et al. ..... 702/182
7,046,584 B2 5/2006 Sorrells
7,079,081 B2 7/2006 Parsche et al.
7,087,341 B2 * 8/2006 Hampden-Smith et al. .. 429/406
7,091,460 B2 8/2006 Kinzer
7,109,457 B2 9/2006 Kinzer
7,115,847 B2 10/2006 Kinzer
7,147,057 B2 12/2006 Steele
7,172,038 B2 2/2007 Terry
7,205,947 B2 4/2007 Parsche
7,312,428 B2 12/2007 Kinzer
7,322,416 B2 1/2008 Burris, II
7,337,980 B2 3/2008 Schaedel
7,354,471 B2 * 4/2008 Hampden-Smith et al. .... 75/332
7,400,490 B2 * 7/2008 Gunderman et al. ..... 361/502
7,438,807 B2 10/2008 Garner et al.
7,441,597 B2 10/2008 Kasevich
7,453,414 B2 * 11/2008 Parsche ..... 343/866
7,461,693 B2 12/2008 Considine et al.
7,484,561 B2 2/2009 Bridges
7,562,708 B2 7/2009 Cogliandro
7,623,804 B2 11/2009 Sone
7,629,497 B2 * 12/2009 Pringle ..... 585/241
7,641,874 B2 * 1/2010 Cha ..... 423/212
7,727,385 B2 * 6/2010 Siy et al. ..... 208/390
2002/0032534 A1 3/2002 Regier
2002/0109642 A1 * 8/2002 Gee et al. ..... 343/876
2003/0024806 A1 * 2/2003 Foret ..... 204/164
2003/0177979 A1 * 9/2003 Crum et al. ..... 118/668
2004/0031731 A1 2/2004 Honeycutt
2004/0207566 A1 * 10/2004 Essig et al. ..... 343/878
2004/0219079 A1 * 11/2004 Hagen et al. ..... 422/194
2005/0024284 A1 * 2/2005 Halek et al. ..... 343/771
2005/0188771 A1 * 9/2005 Lund Bo et al. ..... 73/861
2005/0199386 A1 9/2005 Kinzer
2005/0244338 A1 * 11/2005 Schutt ..... 424/9.52
2005/0274513 A1 12/2005 Schultz
2006/0012535 A1 * 1/2006 McLean ..... 343/742
2006/0033674 A1 * 2/2006 Essig et al. ..... 343/912
2006/0038083 A1 2/2006 Criswell
2006/0038730 A1 * 2/2006 Parsche ..... 343/741
2006/0086604 A1 * 4/2006 Puskas ..... 204/157.15
2006/0166810 A1 * 7/2006 Gunderman et al. ..... 502/64
2007/0095076 A1 * 5/2007 Duke et al. ..... 62/49.2
2007/0104605 A1 * 5/2007 Hampden-Smith et al. .... 419/61
2007/0108202 A1 5/2007 Kinzer

(56) References Cited

U.S. PATENT DOCUMENTS

| | | | | |
|---|---|---|---|---|
| 2007/0131591 | A1* | 6/2007 | Pringle | 208/402 |
| 2007/0137852 | A1 | 6/2007 | Considine et al. | |
| 2007/0137858 | A1 | 6/2007 | Considine et al. | |
| 2007/0166730 | A1* | 7/2007 | Menon et al. | 435/6 |
| 2007/0187089 | A1 | 8/2007 | Bridges | |
| 2007/0261844 | A1 | 11/2007 | Cogliandro et al. | |
| 2008/0006536 | A1* | 1/2008 | Cuomo et al. | 204/672 |
| 2008/0073079 | A1 | 3/2008 | Tranquilla | |
| 2008/0143330 | A1 | 6/2008 | Madio | |
| 2008/0173571 | A1* | 7/2008 | Yen et al. | 208/213 |
| 2008/0248306 | A1* | 10/2008 | Spillmann et al. | 428/403 |
| 2009/0009410 | A1 | 1/2009 | Dolgin et al. | |
| 2009/0242196 | A1 | 10/2009 | Pao | |

FOREIGN PATENT DOCUMENTS

| | | | |
|---|---|---|---|
| DE | 10 2008 022176 | A1 | 11/2009 |
| EP | 0 135 966 | | 4/1985 |
| EP | 0418117 | A1 | 3/1991 |
| EP | 0563999 | A2 | 10/1993 |
| EP | 1106672 | A1 | 6/2001 |
| FR | 1586066 | A | 2/1970 |
| FR | 2925519 | A1 | 6/2009 |
| JP | 56050119 | A | 5/1981 |
| JP | 2246502 | A | 10/1990 |
| JP | 2005109408 | | 4/2005 |
| WO | WO 2007/133461 | | 11/2007 |
| WO | 2008/011412 | A2 | 1/2008 |
| WO | WO 2008/030337 | | 3/2008 |
| WO | WO2008098850 | A1 | 8/2008 |
| WO | WO2009027262 | A1 | 3/2009 |
| WO | WO2009/114934 | A1 | 9/2009 |

OTHER PUBLICATIONS

PCT Notification of Transmittal of the International Search Report and the Written Opinion of the International Searching Authority, or the Declaration, in PCT/US2010/025761, dated Feb. 9, 2011.

PCT Notification of Transmittal of the International Search Report and the Written Opinion of the International Searching Authority, or the Declaration, in PCT/US2010/057090, dated Mar. 3, 2011.

"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm).

Von Hippel, Arthur R., Dielectrics and Waves, Copyright 1954, Library of Congress Catalog Card No. 54-11020, Contents, pp. xi-xii; Chapter II, Section 17, "Polyatomic Molecules", pp. 150-155; Appendix C-E, pp. 273-277, New York, John Wiley and Sons.

United States Patent and Trademark Office, Non-final Office action issued in U.S. Appl. No. 12/396,247, dated Mar. 28, 2011.

United States Patent and Trademark Office, Non-final Office action issued in U.S. Appl. No. 12/396,284, dated Apr. 26, 2011.

Patent Cooperation Treaty, Notification of Transmittal of the International Search Report and the Written Opinion of the International Searching Authority, or the Declaration, in PCT/US2010/025808, dated Apr. 5, 2011.

Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada.

Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of the Institution of Electrical Engineers, © 1986.

Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of the Institution of Electrical Engineers, © 1986.

PCT International Search Report and Written Opinion in PCT/US2010/025765, Jun. 30, 2010.

PCT International Search Report and Written Opinion in PCT/US2010/025772, Aug. 9, 2010.

PCT International Search Report and Written Opinion in PCT/US2010/025763, Jun. 4, 2010.

PCT International Search Report and Written Opinion in PCT/US2010/025807, Jun. 17, 2010.

PCT International Search Report and Written Opinion in PCT/US2010/025804, Jun. 30, 2010.

PCT International Search Report and Written Opinion in PCT/US2010/025769, Jun. 10, 2010.

A. Godio: "Open ended-coaxial Cable Measurements of Saturated Sandy Soils", American Journal of Environmental Sciences, vol. 3, No. 3, 2007, pp. 175-182, XP002583544.

"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.

Burnhan, "Slow Radio-Frequency Processing of Large Oil Shale Volumes to Produce Petroleum-like Shale Oil," U. S. Department of Energy, Lawrence Livermore National Laboratory, Aug. 20, 2003, UCRL-ID-155045.

Sahni et al., "Electromagnetic Heating Methods for Heavy Oil Reservoirs," U.S. Department of Energy, Lawrence Livermore National Laboratory, May 1, 2000, UCL-JC-138802.

Abernethy, "Production Increase of Heavy Oils by Electromagnetic Heating," The Journal of Canadian Petroleum Technology, Jul.-Sep. 1976, pp. 91-97.

Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.

Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.

Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.

Kinzer, A Review of Notable Intellectual Property for In Situ Electromagnetic Heating of Oil Shale, Quasar Energy LLC.

U.S. Appl. No. 12/886,338, filed Sep. 20, 2010 (unpublished).

Butler, R.M. "Theoretical Studies on the Gravity Drainage of Heavy Oil During In-Situ Steam Heating", Can J. Chem Eng, vol. 59, 1981.

Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.

Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.

Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.

Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.

Das, S.K. and Butler, R.M., "Diffusion Coefficients of Propane and Butane in Peace River Bitumen" Canadian Journal of Chemical Engineering, 74, 988-989, Dec. 1996.

Das, S.K. and Butler, R.M., "Mechanism of the Vapour Extraction Process for Heavy Oil and Bitumen", Journal of Petroleum Science and Engineering, 21, 43-59, 1998.

Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.

Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.

(56) References Cited

OTHER PUBLICATIONS

Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23, 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.
Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Heat Transfer Fundamentals for Electro-thermal Heating of Oil Reservoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K, Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N. M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.
Sresty, G.C., Dev, H., Snow, R.N. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing and Other Enhancement on Solvent Aided Process", Journal of Canadian Petroleum Technology, vol. 46, No. 9, pp. 57-61, Sep. 2007.
"Oil sands." Wikipedia, the free encyclopedia. Retrieved from the Internet from: http://en.wikipedia.org/w/index.php?title=Oil_sands &printable=yes, Feb. 16, 2009.
Sahni et al., "Electromagnetic Heating Methods for Heavy Oil Reservoirs." 2000 Society of Petroleum Engineers SPE/AAPG Western Regional Meeting, Jun. 19-23, 2000.
Power et al., "Froth Treatment: Past, Present & Future." Oil Sands Symposium, University of Alberta, May 3-5, 2004.
Flint, "Bitumen Recovery Technology a Review of Long Term R&D Opportunities." Jan. 31, 2005. LENEF Consulting (1994) Limited.
"Froth Flotation." Wikipedia, the free encyclopedia. Retrieved from the internet from: http://en.wikipedia.org/wiki/Froth_flotation, Apr. 7, 2009.
"Relative static permittivity." Wikipedia, the free encyclopedia. Retrieved from the Internet from http://en.wikipedia.org/w/index/php?title=Relative_static_permittivity&printable=yes, Feb. 12, 2009.
"Tailings." Wikipedia, the free encyclopedia. Retrieved from the Internet from http://en.wikipedia.org/w/index.php?title=Tailings &printable=yes, Feb. 12, 2009.
Carlson et al., "Development of the I IT Research Institute RF Heating Process for In Situ Oil Shale/Tar Sand Fuel Extraction—An Overview", Apr. 1981.

* cited by examiner

APPLICATOR AND METHOD FOR RF HEATING OF MATERIAL

STATEMENT REGARDING FEDERALLY SPONSORED RESEARCH OR DEVELOPMENT

[Not Applicable]

CROSS REFERENCE TO RELATED APPLICATIONS

This specification is related to U.S. patent application Ser. No. 12/396,247 filed Mar. 2, 2009, Ser. No. 12/395,995 filed Mar. 2, 2009, Ser. No. 12/395,945 filed Mar. 2, 2009, Ser. No. 12/396,192 filed Mar. 2, 2009, Ser. No. 12/396,284 filed Mar. 2, 2009, Ser. No. 12/396,021 filed Mar. 2, 2009, Ser. No. 12/395,953 filed Mar. 2, 2009, and Ser. No. 12/395,918 filed Mar. 2, 2009, each of which is hereby incorporated herein in its entirety by reference.

BACKGROUND OF THE INVENTION

The disclosure concerns a method and apparatus for application of radio frequency (RF) power to heat material, and more particularly to such a method and apparatus to heat material contained in a vessel.

"Radio frequency" is most broadly defined here to include any portion of the electromagnetic spectrum having a longer wavelength than visible light. Wikipedia provides a definition of "radio frequency" as comprehending the range of from 3 Hz to 300 GHz, and defines the following sub ranges of frequencies:

| Name | Symbol | Frequency | Wavelength |
|---|---|---|---|
| Extremely low frequency | ELF | 3-30 Hz | 10,000-100,000 km |
| Super low frequency | SLF | 30-300 Hz | 1,000-10,000 km |
| Ultra low frequency | ULF | 300-3000 Hz | 100-1,000 km |
| Very low frequency | VLF | 3-30 kHz | 10-100 km |
| Low frequency | LF | 30-300 kHz | 1-10 km |
| Medium frequency | MF | 300-3000 kHz | 100-1000 m |
| High frequency | HF | 3-30 MHz | 10-100 m |
| Very high frequency | VHF | 30-300 MHz | 1-10 m |
| Ultra high frequency | UHF | 300-3000 MHz | 10-100 cm |
| Super high frequency | SHF | 3-30 GHz | 1-10 cm |
| Extremely high frequency | EHF | 30-300 GHz | 1-10 mm |

Reference is made to U.S. Pat. No. 5,923,299, entitled, "High-power Shaped-Beam, Ultra-Wideband Biconical Antenna."

SUMMARY OF THE INVENTION

An aspect of the invention concerns a radio frequency heater comprising a vessel for containing material to be heated and a radio frequency heating antenna or radiating surface (sometimes referred to as an applicator).

The vessel has a wall defining a reservoir. Optionally, the vessel wall can be defined at least in part by the radio frequency radiating surface. The radio frequency radiating surface at least partially surrounds the reservoir. The radiating surface includes two or more circumferentially extending, circumferentially spaced petals that are electrically isolated from other petals. The petals are positioned to irradiate at least a portion of the reservoir, and are adapted for connection to a source of radio frequency alternating current.

Another aspect of the invention is a radio frequency heater including a cyclone vessel having a generally conical wall for containing material to be heated; and a generally conically wound radio frequency radiating conductor running adjacent to the generally conical wall. The conductor is adapted for connection to a source of radio frequency alternating current to heat material disposed within the conical wall.

Another aspect of the invention concerns a method of heating an oil-water process stream, for example a hydrocarbon-water or bitumen-water process stream. In this method a radio frequency heater and an oil-water process stream are provided. A non-limiting example of an oil-water process stream that will benefit from the method is a bitumen-water process stream, produced for example in the course of extracting petroleum or petroleum products from oil sand, oil shale, or other oil formations in which the oil is bound to a mineral substrate. The process stream is irradiated with the heater, thus heating the water phase of the process stream.

Other aspects of the invention will be apparent from this disclosure and the accompanying drawings.

DETAILED DESCRIPTION OF THE PREFERRED EMBODIMENTS

The subject matter of this disclosure will now be described more fully hereinafter with reference to the accompanying drawings, in which one or more embodiments of the invention are shown. This invention may, however, be embodied in many different forms and should not be construed as limited to the embodiments set forth herein. Rather, these embodiments are examples of the invention, which has the full scope indicated by the language of the claims. Like numbers refer to like elements throughout.

The inventors contemplate a conical petroleum ore vessel, e.g. a separation vessel, to incorporate a RF heating antenna. Conical structures may have broad utility in materials handling in the form of cyclone separators, flocculation vessels, chutes and the like. An embodiment of the contemplated vessel is a conical horn antenna for RF heating of petroleum ores during processing and separations.

Conical antennas may include the horn type antennas, the biconical dipole antennas, and the biconical loop antenna (U.S. Pat. No. 7,453,414). The conical horn antenna may be formed from a flaring TEM transmission line and be self exciting if the horn walls include driving discontinuities.

Figure 1:
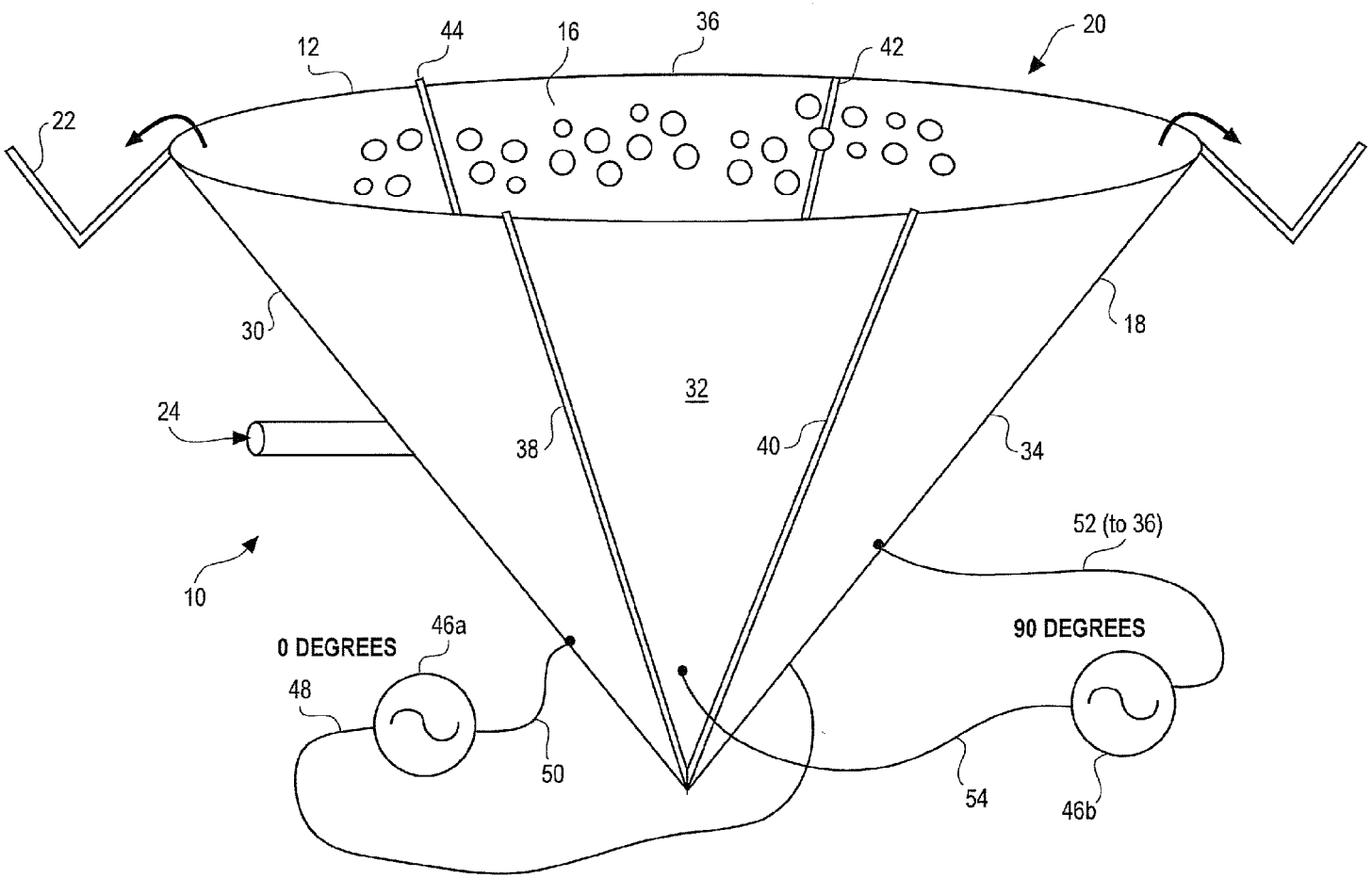
FIG. 1 is a schematic perspective view of a radio frequency heater according to an embodiment.

Referring first to FIG. 1, an embodiment of a radio frequency heater 10 is shown comprising a vessel or tank 12 for containing material 14 to be heated (shown in FIG. 2) and a radio frequency radiating surface 16.

The vessel 12 has a wall 18 defining a reservoir 20. In the embodiment illustrated in FIG. 1, the radiating surface 16 is concave. In this embodiment, the radiating surface 16 is at least generally conical. Alternatively, a radiating surface 16 having a cylindrical, hemispherical, parabolic, hyperbolic, polygonal, or other regular or irregular shape can also be used. A conical radiating surface 16 is favored from the point of view of RF energy transfer efficiency. A cylindrical radiating surface 16 may be favored if the radiating surface 16 is supported by or defines a cylindrical process tank.

In the embodiment illustrated in FIG. 1, the reservoir 20 is defined at least in part by the TEM antenna or RF radiating surface 16. The RF radiating surface 16 at least partially surrounds the reservoir 20, defines at least a portion of the vessel wall 18, and in the illustrated embodiment defines essentially the entire vessel wall 18.

In an alternative embodiment, the vessel 12 can be defined by walls partially or entirely within the confines of the radiating surface 16. For example, a vessel made of material that does not strongly absorb the RF radiation emitted by the radiating surface 16 can be located entirely within the radiating surface 16, or its lower or upper portion can be located within the radiating surface 16, while other portions of the vessel are outside the volume enclosed by the radiating surface 16. For another example, the radiating surface 16 can be an interior lining of the vessel wall 18, or a structure partially or entirely within the confines of the vessel wall 18. In short, the vessel 12 and radiating surface 16 can be entirely coextensive, entirely separate, or partially coextensive and partially separate to any relative degree.

Figure 2:
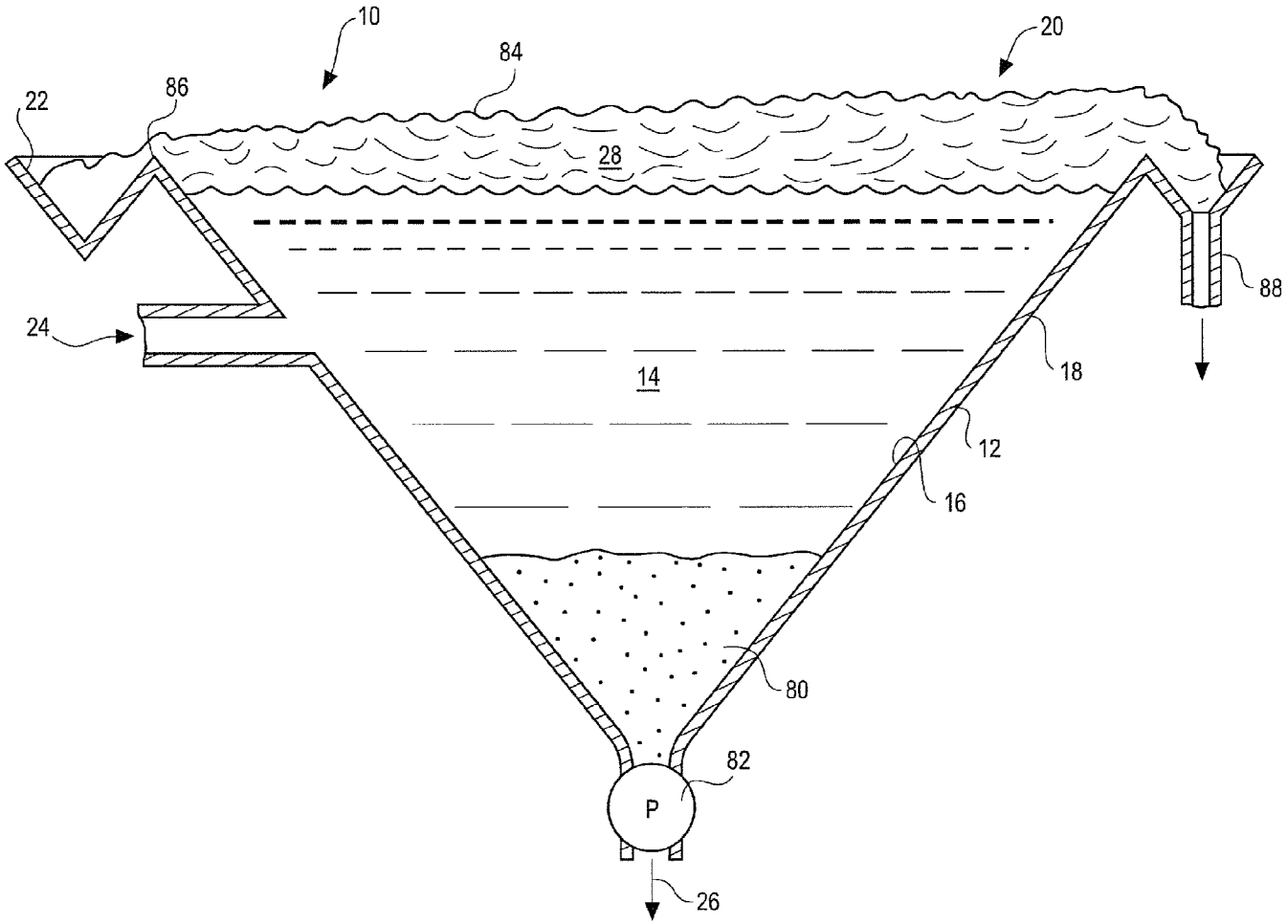
FIG. 2 is a schematic axial section of a radio frequency heater according to an embodiment.

In the embodiment illustrated in FIGS. 1 and 2, the vessel 12 further comprises a spillway 22, a feed opening 24, and a drain opening 26. These features adapt the vessel 12 for use as a separation tank to separate froth 28 from the material 14, as explained further below in connection with the description of a material heating process.

The radiating surface 16 includes two or more, here four, circumferentially extending, circumferentially spaced petals 30, 32, 34, and 36 that are electrically isolated from other petals. In the embodiment illustrated in FIG. 1, the conical radiating surface 16 is double bisected to define four petals 30, 32, 34, and 36 mechanically connected by electrically insulating spacers or ribs 38, 40, 42, and 44. The spacers 38, 40, 42, and 44 join the respective petals 30, 32, 34, and 36 in circumferentially spaced, electrically isolated relation. The petals 30, 32, 34, and 36 are positioned to irradiate at least a portion of the reservoir 20, and are adapted for connection to a source 46 of radio frequency alternating current (RF-AC). The conical radiating surface 16 thus defines a near electric field applicator or antenna that also functions as a heating chamber.

While in the illustrated embodiment the petals 30, 32, 34, and 36 extend the full height of the vessel, and are positioned side-by-side, it will be appreciated that the petals could extend only along a lower portion of the vessel, or only along an upper portion of the vessel, or only along a middle portion of the vessel. Moreover, one set of petals could form or follow the upper portion of the vessel and another set of petals could form or follow the lower portion of the vessel. This could be done to apply different amounts of RF energy to different depths or other portions of the tank, as desired for the process. For example, in the separation process to be described, it may be desired to more strongly heat the middle portion of the vessel, above the inert rock and water settling to the bottom and at or below the foam rising to the top.

In the embodiment illustrated in FIG. 1, a source 46 (shown as separate sources 46A and 46B) of multiphase RF-AC, here four-phase RF-AC, is fed to the petals 30, 32, 34, and 36 via plural conductors 48, 50, 52, and 54 electrically connected to the petals 30, 32, 34, and 36. The multiphase RF-AC may be two-phase, three-phase, four-phase, five-phase, six-phase, 12-phase, or any other number of phases. In the embodiment illustrated in FIG. 1, the RF-AC fed to each petal such as 30 is 360/x degrees out of phase with respect to the alternating current fed to each adjacent petal, in which x is the number of phases of the multiphase radio frequency alternating current. Here, the RF-AC is four-phase, so x=4. Each petal such as 30 is 90 degrees out of phase with respect to the following petal such as 32 and the preceding petal such as 36, and 180 degrees out of phase with respect to the opposed petal such as 34, so the application of RF current provides a traveling wave or rotating RF field distribution. This quadrature phasing of the cone petals ensures even heating by forming a rotating, traveling wave distribution of currents and electromagnetic fields.

It will be appreciated that the number of petals and the number of phases of the multiphase RF-AC do not need to be equal, nor do all the petals 30, 32, 34, and 36 need to be out of phase with each other, nor do the phase differences between respective petals need to be the same, nor do all the petals need to be fed RF-AC at any given time.

The source of RF-AC can be configured to provide RF-AC current having a voltage, frequency, and power adapted to heat the contents 14. Particularly contemplated in the present context is a frequency within the more energetic radio frequency range of 300 MHz to 300 GHz, such as UHF, VHF, and EHF radiation, although operative ranges outside these values are contemplated. More preferred for the present purposes is a frequency within the range of from 300 MHz to 3 GHz, although operative frequencies outside these values are contemplated. The amount of power irradiated into the reservoir 20 depends on such factors as the mass and absorbance spectrum of the material 14 to be heated or components of the material 14, the frequency of the RF, the material temperature(s) before and during the process, and the desired heating rate. The use of a near field applicator allows the use of relatively low RF frequencies, which penetrate the material 14 better than higher frequencies.

Figure 3:
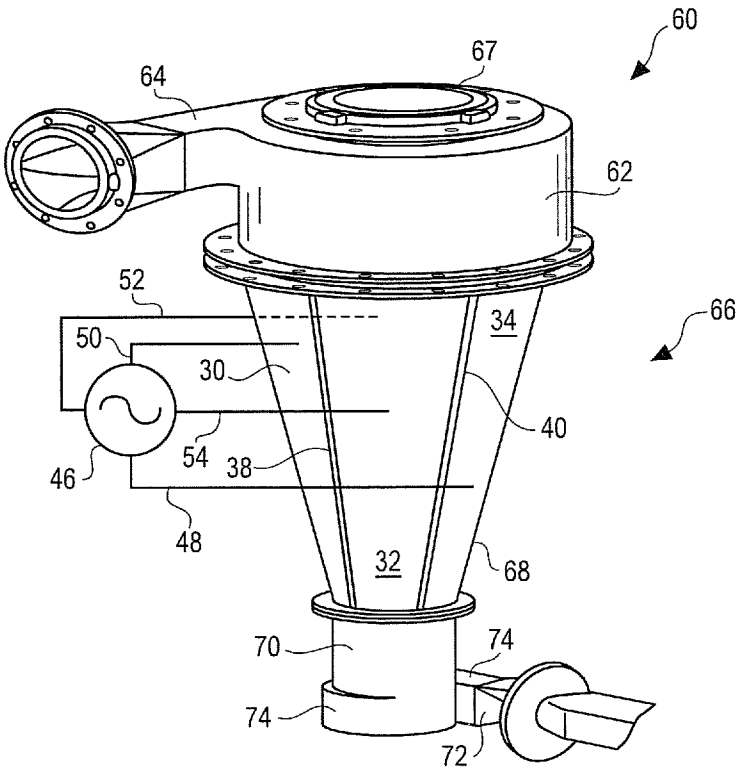
FIG. 3 is a modification of FIG. 5 of U.S. Pat. No. 6,530,484, and shows a schematic side perspective view of another aspect of the disclosure.

The radio frequency heater can alternatively be adapted for use in many other types of equipment, for example the cyclone separator 60 shown in FIG. 3. FIG. 3 is modified from FIG. 5 of U.S. Pat. No. 6,530,484, all of which is incorporated here by reference.

Referring to FIG. 3, the cyclone 60 comprises an inlet chamber 62 having a tangential inlet 64. Raw feed introduced into the inlet chamber 62 through the tangential inlet 64 will swirl circularly in the inlet chamber 62, resulting in a separation of denser (high gravity) material from less dense (low gravity) material. The denser material moves to the outer peripheral zone of the inlet chamber 62 and downward into the coaxial section 66, while the less dense material reports toward the axis of the inlet chamber 62 at a vortex formed by the swirling motion and upward, and is output from the low-gravity outlet 67.

A conical section 68 of the coaxial section 66 extends from the inlet chamber 62 and terminates in a generally cylindrical outlet chamber 70. A high gravity fraction outlet 72 for the high gravity fraction of separated material is disposed in the outlet chamber 70, and will be arranged generally tangentially relative to the periphery of the outlet chamber 70, the arrangement being one wherein the outlet faces into the stream of particles rotating in the outlet chamber 70. An evolute structure 74 is provided at the underflow high gravity fraction outlet 72 of the cyclone 60. The evolute structure 74 spirals outwardly from the outlet chamber 70 through about 180 degrees, and merges with the generally tangential high gravity fraction outlet 72 for the coarse fraction of material.

The RF heating apparatus in the cyclone of FIG. 3 is analogous to the corresponding structure of FIGS. 1 and 2, bears corresponding reference characters, and is not separately described here. RF heating can be used in this embodiment, for example, to prevent a gaseous, RF-absorbing fraction from condensing in the coaxial section 66. This will assist in directing the RF-absorbing fraction to the outlet 67 instead of the outlet 72.

Figure 5:
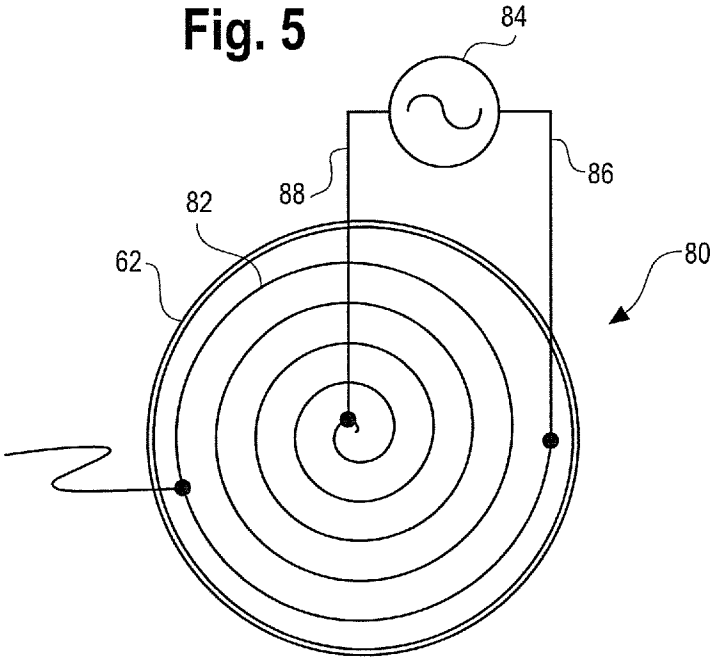
FIG. 5 is a plan view of the embodiment of FIG. 4.
Figure 4:
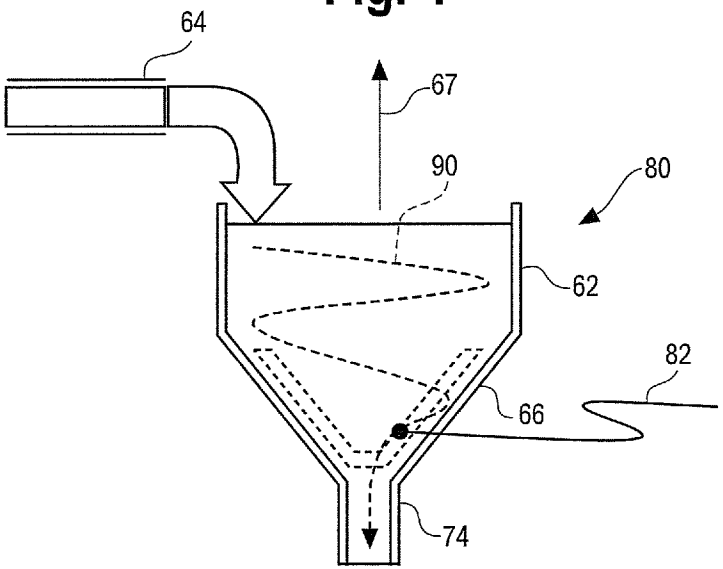
FIG. 4 is a sectional diagrammatic view of another aspect of the disclosure.

A variation on the applicator of FIG. 3 is shown in FIGS. 4 and 5. The cyclone 80 comprises an inlet chamber 62 having a tangential inlet 64. Raw feed introduced into the inlet chamber 62 through the tangential inlet 64 will swirl circularly in the inlet chamber 62, resulting in a separation of denser (high gravity) material from less dense (low gravity) material. The denser material moves to the outer peripheral zone of the inlet chamber 62 and downward into the coaxial section 66, while the less dense material reports toward the axis of the inlet chamber 62 at a vortex formed by the swirling motion and upward, and is output from the low-gravity outlet 67.

In the embodiment of FIGS. 4 and 5, the applicator 82 is a conically wound conductor, which can be for example a Litz conductor as shown in U.S. Pat. No. 7,205,947, incorporated by reference here. The applicator 82 preferably is wound downward from the peripheral edge to the center in the direction of flow of material from the tangential inlet 64, to reduce the effect of the applicator 82 on flow within the coaxial section 66. The applicator 82 is fed with RF alternating current from a power source 84 via feed conductors 86 and 88 attached to the central and peripheral ends of the applicator 82. A contemplated advantage of this embodiment is that the swirling fluid generally indicated as 90 is always close to a portion of the applicator 82 in the coaxial section 66, tending to evenly heat the fluid 90.

Another aspect of the disclosure concerns a method of heating an emulsion, dispersion, froth or slurry, referred to generally as a process stream. In this method a radio frequency heater 10, such as shown in FIGS. 1 and 2, and an oil-water process stream, for example a bitumen-water process stream (the material 14) are provided. A non-limiting example of an oil-water process stream that will benefit from the method is a bitumen-water process stream 14, produced for example in the course of extracting petroleum or petroleum products from oil sand, oil shale, or other oil formations in which the oil is bound to a mineral substrate. The process stream can include additives in the water, such as sodium hydroxide added to separate the bitumen from sand, clay, or other substrates.

The process stream 14 is irradiated with the heater 10, thus heating the water phase of the process stream. The heater selectively heats the water in the oil-water process stream, as the bitumen oily phase and the mineral substrate do not strongly absorb the RF-AC radiated into the material 14. The bitumen phase is not strongly heated because it has a low dielectric dissipation factor, so it is relatively resistant to dielectric heating; a near-zero magnetic dissipation factor, so it is not subject to magnetic moment heating; and near-zero electrical conductivity, so it is not subject to resistance heating. The water in the process stream thus serves as an RF susceptor, receiving the RF-AC and effectively converting it to heat.

The phases of process stream can be very close together (a typical emulsion has a dispersed phase particle diameter of roughly one micron or less, though "emulsion" is more broadly defined here to include a dispersed particle size of less than 500 microns, alternatively less than 200 microns, alternatively less than 100 microns, alternatively less than 50 microns, alternatively less than 10 microns, alternatively less than 5 microns). Process streams with larger particles, such as the sand in an ore-water slurry, are also contemplated. Assuming a 1-micron dispersed phase, the heat generated in the surrounding water only needs to be conducted about 0.5 microns from the outsides to the centers of the particles or droplets of a dispersed phase. The water is very heat-conductive, has a high heat capacity, and absorbs RF energy directly, so conductance through the water to other components is rapid.

Referring again to FIG. 2 in particular, the separation process carried out there is described in more detail, with reference to separation of bitumen, petroleum, or their cracked products from mined oil sand ore or other bitumen ore (broadly defined to include oil sand, oil shale, and other such ores yielding petroleum products).

The mined oil sand ore, produced for example by strip mining a formation, is sand coated with water and bitumen. The ore is combined with water and agitated to produce a sand/water slurry comprising bitumen carried on the sand. Additives, such as lye (sodium hydroxide) are added to emulsify the water and the bitumen.

The slurry is introduced to the vessel 12 via the feed opening 24, adding to the body of material 14. In the vessel 12, the sand fraction 80 of the material 14 is heavier than the water medium. The sand fraction and excess water drop to the bottom of the vessel 12 to form a sand slurry 80 that is removed through the drain opening or sand trap 26. A slurry pump 82 is provided to positively remove the sand slurry 80.

The bitumen fraction of the material 14 is lighter than the water medium. The bitumen fraction is floated off of the sand and/or is emulsified in the water and rises to the top of the slurry. Agitation optionally can be provided in at least the upper portion of the vessel 12, forming bubbles that float the bitumen-rich fraction upward. The top fraction 28 is a froth comprising a bitumen-rich fraction dispersed in water, which in turn has air dispersed in it. The froth is richer in bitumen than the underlying material 14, which is the technical basis for separation.

In an embodiment, the froth 28 and the water in the material 14 are selectively heated by RF-AC radiation as described above. The bitumen and sand are not directly heated, as they have little absorbance for RF-AC, but the water strongly absorbs the RF-AC and is efficiently heated. The heating of the bitumen/water process stream can also be increased by adding a susceptor other than water—an RF-AC absorbent particulate or fibrous material distributed in the material 14, as described in specifications incorporated by reference above.

The application of heat and agitation to the bitumen/water process stream tends to reduce the viscosity of the bitumen and generate a froth to which separated bitumen particles adhere, forming a bitumen froth. The bitumen froth rises to the top of the vessel 12. The heat in the bitumen froth carried over to the particle separation processes eases separation of foreign particles such as clay in particle settling or centrifuging apparatus.

The bitumen-rich froth 28 is forced upward by the entering material 14 until its surface 84 rises above the weir or lip 86 of the vessel 12. The weir 86 may encircle the entire vessel 12 or be confined to a portion of the circumference of the vessel 12. The froth 28 rising above the level of the weir 86 flows radially outward over the weir 86 and down into the spillway 22, and is removed from the spillway 22 through a froth drain 88 for further processing.

It is contemplated that an analogous process employing the application of RF-AC heating can be used in a wide variety of different industrial processes and equipment, such as separation, flocculation, gravity separation of liquids, reaction vessels, etc.

An advantage of RF-AC heating is that it only heats certain materials that absorb it strongly, so energy is not wasted heating other materials, even if they are in close proximity to the materials intended to be heated.

Another advantage is that heat is provided in a controlled fashion not involving nearby combustion of fuel. The vessel 12 or a feed pipe is occasionally breached, since the material 14 is chemically corrosive (containing lye) and physically corrosive (containing sand). If the vessel 12 were heated by a flame or flue gases fed with fossil fuel, and a large quantity of bitumen contacted the flame due to a breach or otherwise, the result could be a substantial fire. For this reason, open flame heating is desirably avoided.

Also, RF-AC energy heats all the water in the material 14, not just the material nearest the source of heat. More uniform heating is thus provided.

Moreover, unlike steam injection, RF-AC heating does not add additional water to the material being heated. In the case of heating a slurry of bituminous ore in water, the addition of more than a minimal amount of water is undesirable, as such water needs to be separated and processed so it can be disposed of in an environmentally acceptable way. The same is true of many other industrial processes in which water used in the process needs to be removed, and in some cases treated, before being released to the environment.

The invention claimed is:

1. A radio frequency (RF) heater comprising:

a multiphase RF Alternating Circuit (AC) source;

a plurality of petals arranged in side-by-side relation and having a concave shape to define a conically shaped hydrocarbon resource container configured to RF heat a hydrocarbon resource therein, each petal being electrically isolated from adjacent petals; and a plurality of conductors electrically coupling said multiphase RF AC source to said plurality of petals;

said multiphase RF AC source being configured to supply multiphase RF AC to each petal and being 360/x degrees out of phase with respect to the multiphase RF AC at a next adjacent petal, wherein x is a number of phases of the multiphase RF AC.

2. The RF heater of claim 1, wherein said RF source has a frequency and power to heat liquid water.

3. The RF heater of claim 1, further comprising a respective electrically insulated spacer between each adjacent pair of said petals.

4. The RF heater of claim 1, wherein said plurality of petals is four in number.

5. The RF heater of claim 1, wherein the conically shaped hydrocarbon resource container has at least one fluid passageway therein.

6. A radio frequency (RF) heater comprising:

an RF source;

a conically shaped hydrocarbon resource container configured to carry a hydrocarbon resource therein; and a conically wound RF conductor coupled to said RF source and carried by said conically shaped hydrocarbon resource container to heat the hydrocarbon resource.

7. The RF heater of claim 6, wherein said conically wound RF conductor is carried within said conically shaped hydrocarbon resource container.

8. The RF heater of claim 6, wherein said RF source has a frequency and power to heat liquid water.

9. The RF heater of claim 6, wherein said conically shaped hydrocarbon resource container has at least one fluid passageway therein.

10. A method of heating a hydrocarbon resource comprising:

providing a multiphase RF Alternating Circuit (AC) source;

coupling a plurality of conductors electrically between the multiphase RF AC source and the plurality of petals; and supplying RF energy from the RF source to RF heat the hydrocarbon resource carried within a plurality of petals arranged in side-by-side relation and having a concave shape to define a conically shaped hydrocarbon resource container, each petal being electrically isolated from adjacent petals;

the multiphase RF AC source supplying multiphase RF AC to each petal and being 360/x degrees out of phase with respect to the multiphase RF AC at each adjacent petal, wherein x is a number of phases of the multiphase RF AC.

11. The method of claim 10, wherein providing the RF source comprises providing an RF source having a frequency and power to heat liquid water.

* * * * *